US005611281A

United States Patent [19]

Corrado et al.

[11] Patent Number: 5,611,281

[45] Date of Patent: Mar. 18, 1997

[54] SYSTEM FOR CLEANING PARTICLES FROM A SURFACE

[75] Inventors: Frank C. Corrado; James W. Fischer, both of Rochester; Gary R. Larsen, Webster; Ronald W. Sweet, Conesus, all of N.Y.

[73] Assignee: Serater LLC, Livonia, N.Y.

[21] Appl. No.: 439,063

[22] Filed: May 8, 1995

[51] Int. Cl.[6] ..... B41F 35/00

[52] U.S. Cl. ..... 101/425; 101/423

[58] Field of Search ..... 101/425, 424, 101/423; 15/256.53, 256.51

[56] References Cited

U.S. PATENT DOCUMENTS

| | | | |
|---|---|---|---|
| 3,089,415 | 5/1963 | Grembecki et al. | 101/425 |
| 3,611,927 | 10/1971 | Johnson | 101/425 |
| 4,009,047 | 2/1977 | Lindsay | 134/9 |
| 4,171,552 | 10/1979 | Leifeld | 101/425 |
| 4,953,463 | 9/1990 | Hara | 101/425 |
| 4,982,469 | 1/1991 | Nishiwaki | 15/3 |
| 5,251,348 | 10/1993 | Corrado et al. | 15/256.53 |
| 5,275,104 | 1/1994 | Corrado et al. | 101/425 |
| 5,337,767 | 8/1994 | Ernst et al. | 134/104.1 |
| 5,349,714 | 9/1994 | Korbonski et al. | 15/3 |

*Primary Examiner*—Edgar S. Burr
*Assistant Examiner*—Anthony H. Nguyen
*Attorney, Agent, or Firm*—M. Lukacher; R. C. Brown

[57] ABSTRACT

A system for axially reciprocating a tacky roller (contact cleaning roller, or CCR) across a substrate being cleaned by the roller, to spread particles which are non-uniformly distributed on the substrate surface over a broader area of the tacky roller collecting surface, thereby decreasing the rate of decay of collecting efficiency, improving the average cleanliness of the treated substrate, and extending the operating lifetime of the tacky roller between renewals. The roller may or may not be in contact with the substrate surface during reciprocation of the roller. The system includes a second CCR to alternate with the first CCR, such that at least one roller is cleaning the substrate while another roller is being renewed. The system can be configured to provide full-width CCRs which overlap both edges of a surface at all times during reciprocation. It also can include shorter CCRs for cleaning only a portion of a surface, such as along only one edge, and can also include CCRs substantially shorter than the width of the substrate which can be programmed to reciprocate periodically across the entire substrate width. The system is useful for cleaning workpiece substrates, such as webs and sheets, and also process hardware elements such as calender rollers, coating rollers, conveyance rollers, and other CCRs having surfaces of lower tackiness.

24 Claims, 8 Drawing Sheets

SYSTEM FOR CLEANING PARTICLES FROM A SURFACE

DESCRIPTION

The present invention relates to a system (apparatus and method) for cleaning particles from surfaces, particularly to a system for cleaning surfaces by the rolling contact of a cleaning roller with the surface, and more particularly by reciprocation of the cleaning roller in a direction transverse to the roller and to the direction of rolling (in a direction along the axis of rotation of the cleaning roller) while rolling is occurring.

The system provided by the invention is especially suitable for removal of particles from process surfaces, which is an important step of many manufacturing processes, for example, the coating of photographic and magnetic films, the making of integrated circuits, and the calendering of webs. Such coatings may be on a substrate for the coating and are referred to as substrate surfaces. The term substrate surface as used herein includes the surface of a body whether or not the body is a substrate for a coating or the like, for example, a process roller such as a calender roller or a conveyance roller can be a substrate having a surface cleanable by a system in accordance with the invention. By particles is meant small foreign objects, typically of various shapes, materials, and sizes which may be in the range of 1 μm. Such particles may adhere to surfaces by electrostatic forces which may exceed $10^5$G, making removal by blowing air onto a surface or wiping a surface ineffective for removing particles.

It is known that a roller having a surface comprising one or more of various organic polymers, and especially including a polyurethane, can be very effective in removing particles from a substrate surface when in contacting relationship with the surface to be cleaned of particles. The roller surface exhibits a tacky behavior when contacting the surface as if being adhesive although there is no adhesive present on the roller. As the roller rolls over the surface, particles on the surface find greater attraction to the roller surface and become transferred thereto. U.S. Pat. Nos. 4,009,047 to Lindsay, 5,251,348 to Corrado et al., and 5,337,767 to Ernst et al. disclose tacky rollers for cleaning. These rollers are also known as particle transfer rollers, or PTRs, and as contact cleaning rollers, or CCRs. For convenience, rollers used in the system of this invention are referred to herein as CCRs, without limitation to the mechanisms of particle adherence or tackiness operative therein, and include CCRs such as described in the above referenced patents but without limitation thereto. The cleaning roller may be a roller having a surface which is tacky with respect to the surface being cleaned when contacting the surface.

The cleaning effectiveness of a CCR is directly related to the ability of the roller surface to come into contact with a particle to be removed. During operation, each removed particle deposited at a site on the CCR surface blocks that site from acquiring additional particles, and the effectiveness of the CCR can decrease as the surface progressively becomes covered with removed particles. To maintain continuous cleaning effectiveness over a substrate, it has been proposed to use a plurality of CCRs. One CCR is disposed out of substrate cleaning position and in position to be cleaned, or "renewed," by an adjunct cleaning apparatus while at least another CCR is in substrate cleaning position. These proposals may comprise a rotating turret of CCRs, as in the above-referenced patent to Corrado et al, or CCRs mounted on movable arms, as in the above-referenced patent to Ernst et al. In some cleaning applications, wherein the concentration of particles to be removed is high, it can be difficult for the cleaning/renewal cycle to keep up with the rate at which the operating CCR becomes loaded and ineffective. Thus there exists a need to extend the working life of a CCR between cleanings.

In many cleaning applications, the particles to be removed are not distributed uniformly over the width of the substrate surface, but instead may be highly concentrated near one or both edges across the width of the substrate. One reason for this can be that the edges of substrates have a greater exposure to contamination from the environment than do areas inboard from the edges. Also, many substrates have one or more continuous slit edges, and slitting itself can generate large quantities of "slitter dirt." In these applications, the active areas of the contact cleaning roller in the vicinity of the substrate edges can become clogged quite rapidly, requiring change-out of the clogged CCR although areas of the roller surface only a short axial distance away can be still virtually unsullied.

It is a principal object of the invention to provide an improved system (apparatus and method) for cleaning a substrate surface of particles wherein the operating life of a contact cleaning roller between renewal operations is increased.

It is a further object of the invention to provide an improved system for cleaning a substrate surface of particles wherein non-uniform distributions of particles being removed from the surface are distributed more uniformly axially over the surface of the contact cleaning roller.

It is a still further object of the invention to provide an improved system for cleaning a substrate surface of particles wherein the average cleanliness of surface cleaned is increased.

Briefly described, apparatus in accordance with the invention includes a contact cleaning roller disposed to remove particles from a substrate surface by being in rolling contact with the surface. The contact cleaning roller can also be moved in a direction transverse to the axis of rotation of the roller (axially), and preferably reciprocally, along the substrate surface. In many applications, the majority of particles collected by a CCR originate near the edges of the substrate surface being cleaned. Reciprocating a CCR axially broadens the CCR surface area exposed to the substrate edge and thus extends the length of use of a CCR between cleanings or renewals of the surface. Preferably, the reciprocal movement occurs while the CCR is cleaning the substrate. Alternatively, the CCR can be retracted from cleaning position, displaced axially to a new axial location, and moved back into cleaning position. Preferably, the rotational speed of the CCR is matched to the linear speed of a moving substrate before the CCR is brought into contact with the substrate.

The invention is useful in cleaning a wide variety of substrates including, but not limited to, plastic, metal, and paper webs and sheets, rigid objects such as circuit boards and silicon wafers, and process rollers such as steel and polymer calender rollers, coater backing rollers, and conveyance rollers while they are moving. The invention can also be embodied in apparatus for cleaning stationary substrates, for example, large astronomical mirrors, wherein a movable CCR system is rolled along the surface of the stationary substrate.

The foregoing and other objects, features, and advantages of the invention, as well as presently preferred embodiments thereof, will become more apparent from a reading of the following description in connection with the accompanying drawings in which.

Figure 1:
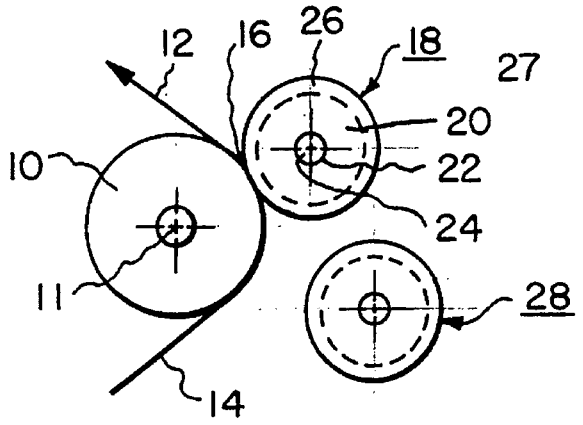
FIG. 1 is a schematic, vertical cross-sectional view of a conveyance roller and two contact cleaning rollers in accordance with the invention, one CCR shown in position to clean the proximal surface of a web being conveyed and the other CCR in position to be renewed.

Referring to FIGS. 1–6, a progressive addition of components is shown which provides a schematically complete system in accordance with the invention for cleaning particles from a web surface. It should be understood that the web cleaner described in detail hereinbelow is only one embodiment of the invention. Other embodiments adapted for cleaning the surfaces of other substrates, such as process rollers and the like (including other CCRs having lower tackiness), while not specifically described herein are fully within the spirit and scope of the invention.

A backing conveyance roller 10 is wrapped by a moving web 12 having particles to be removed from first web substrate surface 14. At a nip point 16, a first contact cleaning roller 18 is disposed in a first, or cleaning, position against web surface 14. Roller 10 rotates about its own axis 11 and may be driven or idle. CCR 18 has a core 20, made preferably of steel, and an axle 22 containing the axis 24 of the roller. Core 20 is covered by a shell 26 which includes a polymer, for example, silicone rubber, neoprene or butyl rubber, or preferably a polyurethane.

The surface 27 of CCR 18 displays an affinity for a very wide range of microscopic particles. The affinity depends less on the composition of the particles than on their size. The attractive force of a particle to a surface is inversely proportional to the square of the radius of the particle. Thus, very small particles, in the range of 1μm or less, can require accelerations greater than $10^5$ G to release them from a surface such as surface 14. The polymers of the shell of a CCR, by their very nature, exhibit an inherent "tack" and are able to overcome this surface attraction and bind these particles to themselves, thereby cleaning the surface against which they are rolled.

A second CCR 28, preferably identical to first CCR 18, is shown out of contact with web surface 14 and in a second, or renewal, position. After collecting a great many particles, the surface of a CCR becomes partially covered by particles, and it is no longer able to collect and retain a desired percentage, typically 90% or greater, of the particles subsequently presented to it. Renewal is a known process for removing collected particles from the surface of a CCR and restoring its particle-collecting capability. Proposals for renewal are disclosed, for example, in the U.S. Patents cited hereinabove. Continuous renewal of a CCR in cleaning position is impractical by these proposals, since liquid cleaners are involved which in general cannot be permitted to be tracked onto a substrate being cleaned; thus the need to move the CCR away from the substrate surface before beginning renewal.

Figure 2:
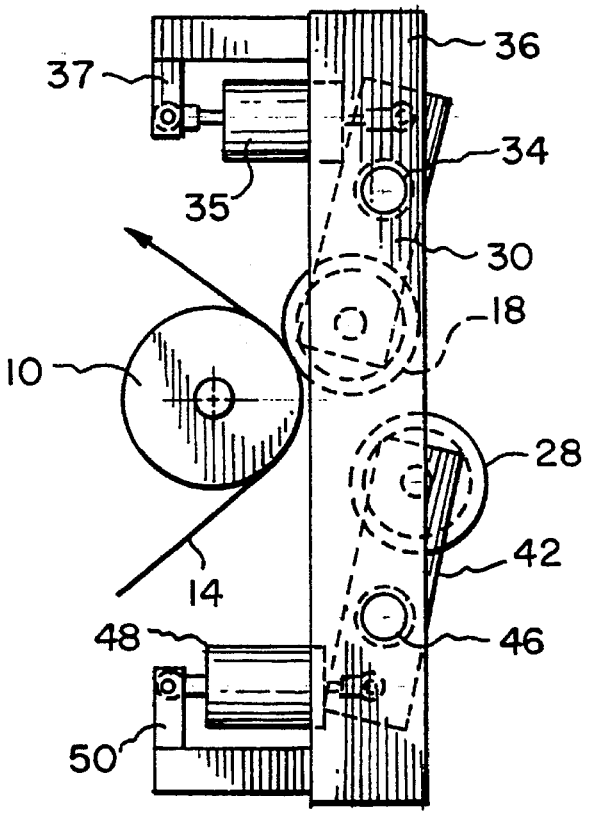
FIG. 2 is a view, like FIG. 1, also showing movable mounting elements supporting the CCRs.

First CCR 18 is disposed between extensions of first and second pivot arms 30 and 32, which are themselves pivotably disposed on first shaft 34. Shaft 34 is supported by movable frame 36 through which shaft 34 extends and is attached at points 38 and 40. Pivot arms 30 and 32 are rigidly connected to pivot together on shaft 34 by first cross-member 33. A first actuator 35 is disposed between cross-member 33 and first frame extension 37. Actuator 35 can be, for example, a double-acting pneumatic or hydraulic cylinder, controlled by known control means to pivot first CCR 18 into either its cleaning position, as shown in FIG. 2, or its renewal position.

Second CCR 28 is similarly, preferably identically, disposed with respect to components analogous to those used with first CCR 18, that is, third and fourth pivot arms 42 and 44, second shaft 46, second actuator 48, and second movable frame extension 50. As shown in FIG. 2, second CCR 28 is in renewal position.

Figure 4:
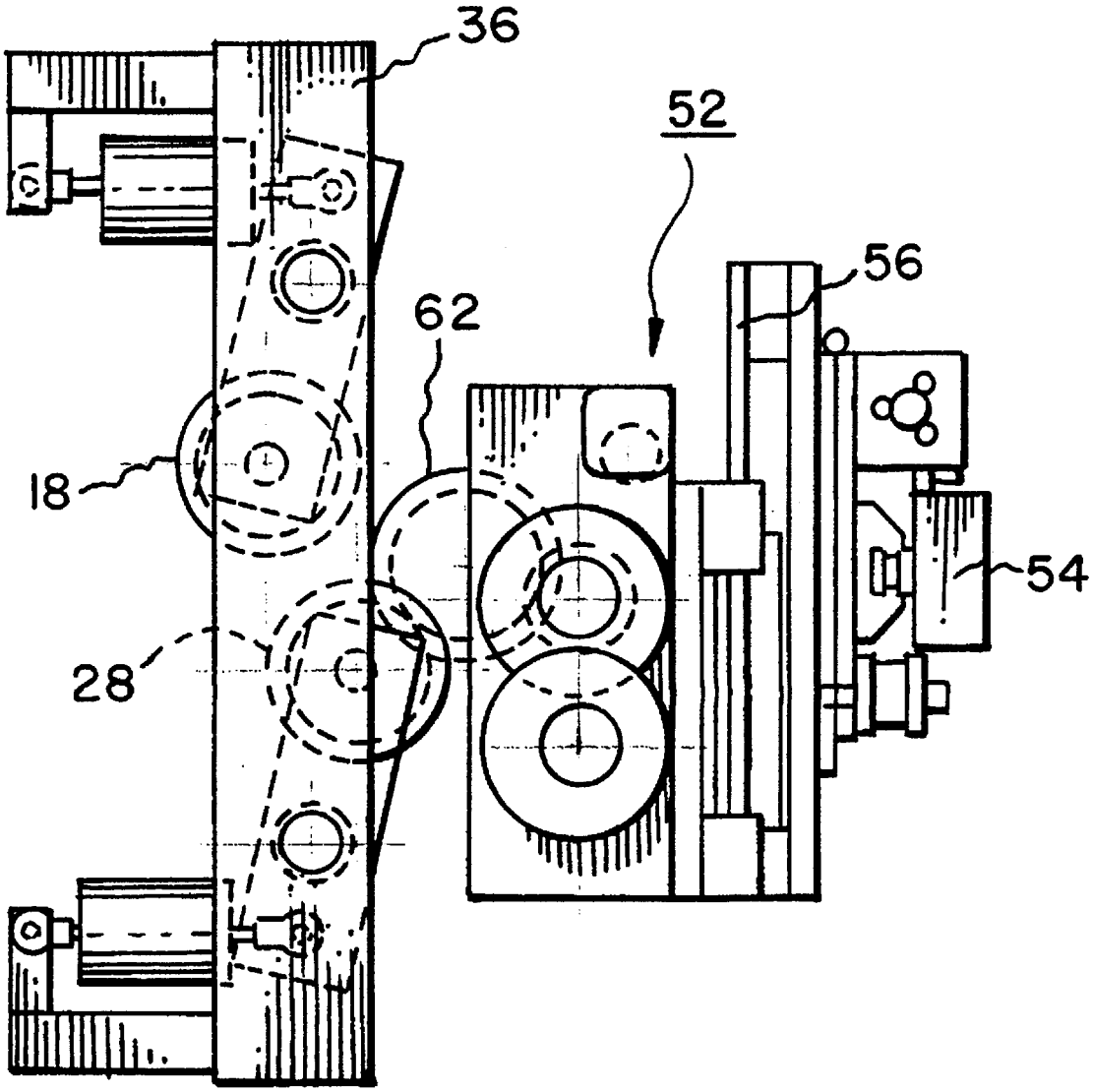
FIG. 4 is a view, like FIG. 2, also showing a roller cleaner in position to renew one of the CCRs.
Figure 5:
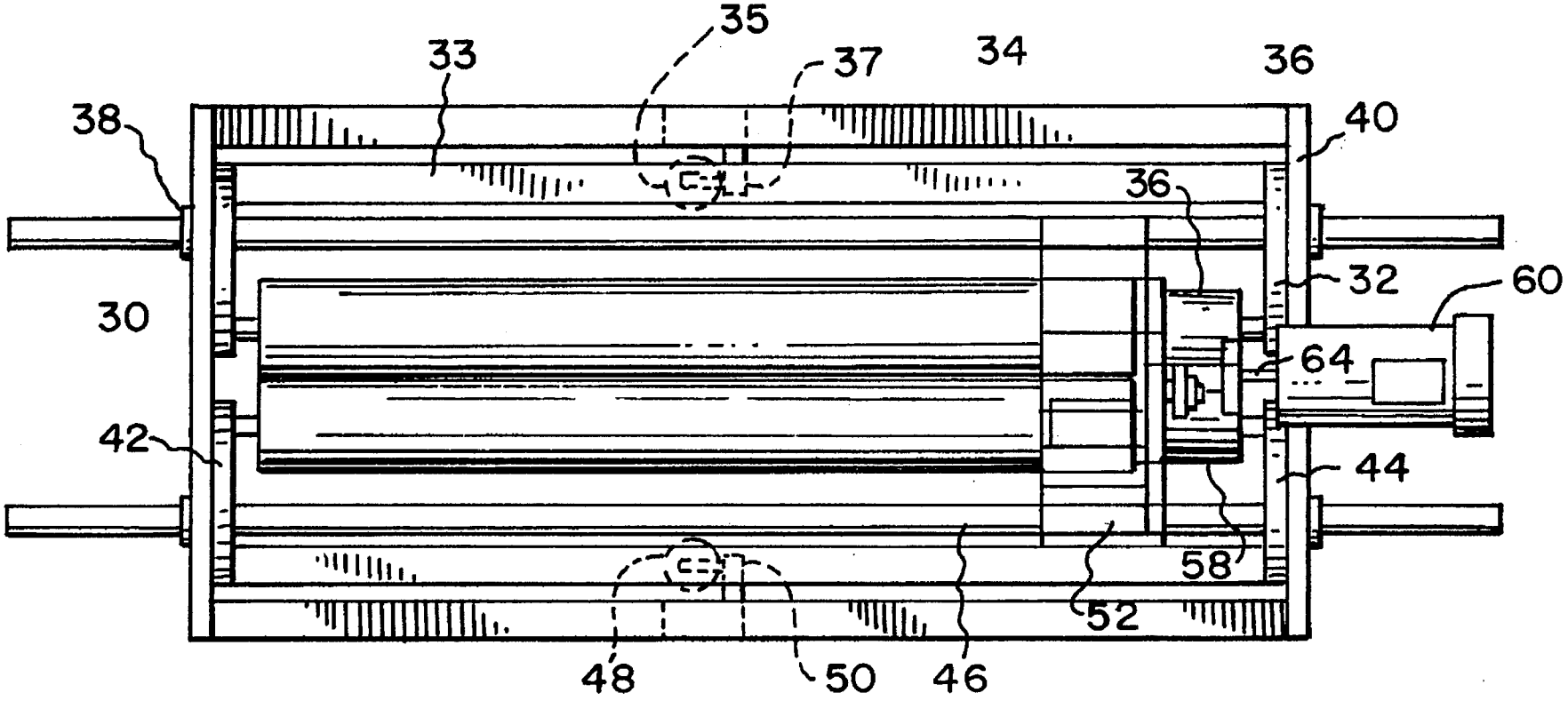
FIG. 5 is a vertical elevational view of two CCRs mounted in a movable frame, showing the roller cleaner of FIG. 4 and roller speed-matching apparatus.

Renewal apparatus, comprising a roller cleaner 52, is disposed adjacent to the CCRs as shown in FIGS. 4 and 5. This apparatus can be substantially as disclosed for cleaning of process rollers in U.S. Pat. No. 5,275,104 to Corrado et al., which is hereby incorporated by reference. Preferably, cleaner 52 is mounted on a rail 54 which is parallel to the axes of the two CCRs. Cleaner 52 can thus can be positioned manually at any desired widthwise location of the CCRs, or it can be driven to any position or caused to reciprocate according to any desired algorithm along rail 54 by known means (not shown), for example, a lead screw, a cable and pulley, or angled bearings on a smooth rotating drive shaft. Cleaner 52, in the preferred embodiment, is further disposed on track 56 which is orthogonal to rail 54, permitting the cleaner to alternate between positions for cleaning first CCR 18 or second CCR 28.

In operation, one of the CCRs is in cleaning position while the other is in renewal position. To change out a loaded roller for renewal, preferably the renewed roller is brought up to line speed and is re-engaged with the web surface before the loaded roller is pivoted into renewal position, thus ensuring continuous cleaning of the web surface.

FIGS. 4 and 5 also show preferred means for matching the rotational speed of either of the CCRs to the line speed of the substrate prior to contact. Each of the CCRs has an end portion 58 wherein the roller surface is polished metal, conveniently formed, for example, by omitting the polymer shell from this portion. A variable-speed motor 60 driven by, for example, a tach-generator (not shown) taking its signal from the line speed of substrate conveyance, is coupled in driving relationship to either CCR when in the cleaning position through a friction-drive wheel 62 on the shaft 64 of motor 60. The renewed CCR is thus turning at speed congruent with the line speed of the substrate when the CCR is re-engaged in cleaning position, thereby avoiding potential scuffing of the substrate surface.

Figure 3:
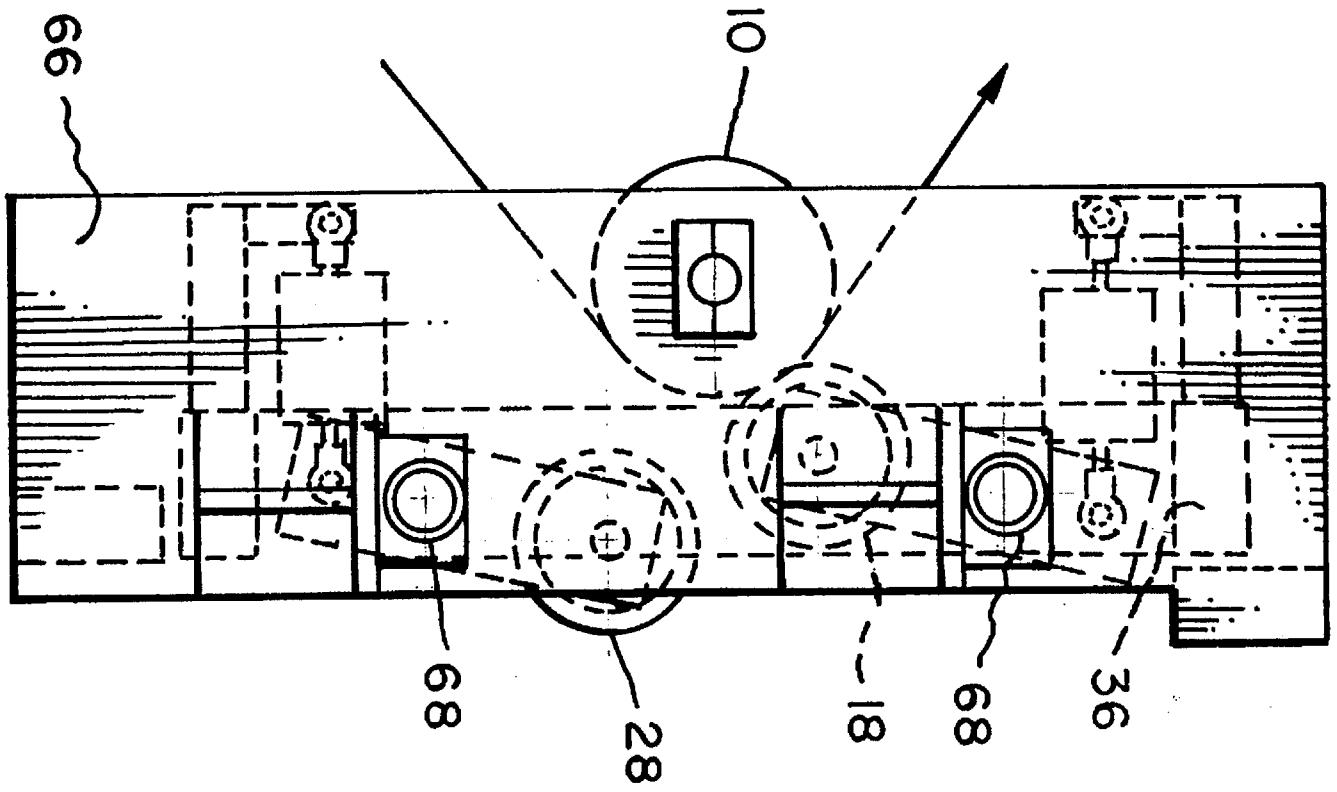
FIG. 3 is a view, like FIG. 2, also showing fixed mounting elements supporting the movable mounting elements shown in FIG. 2.
Figure 6:
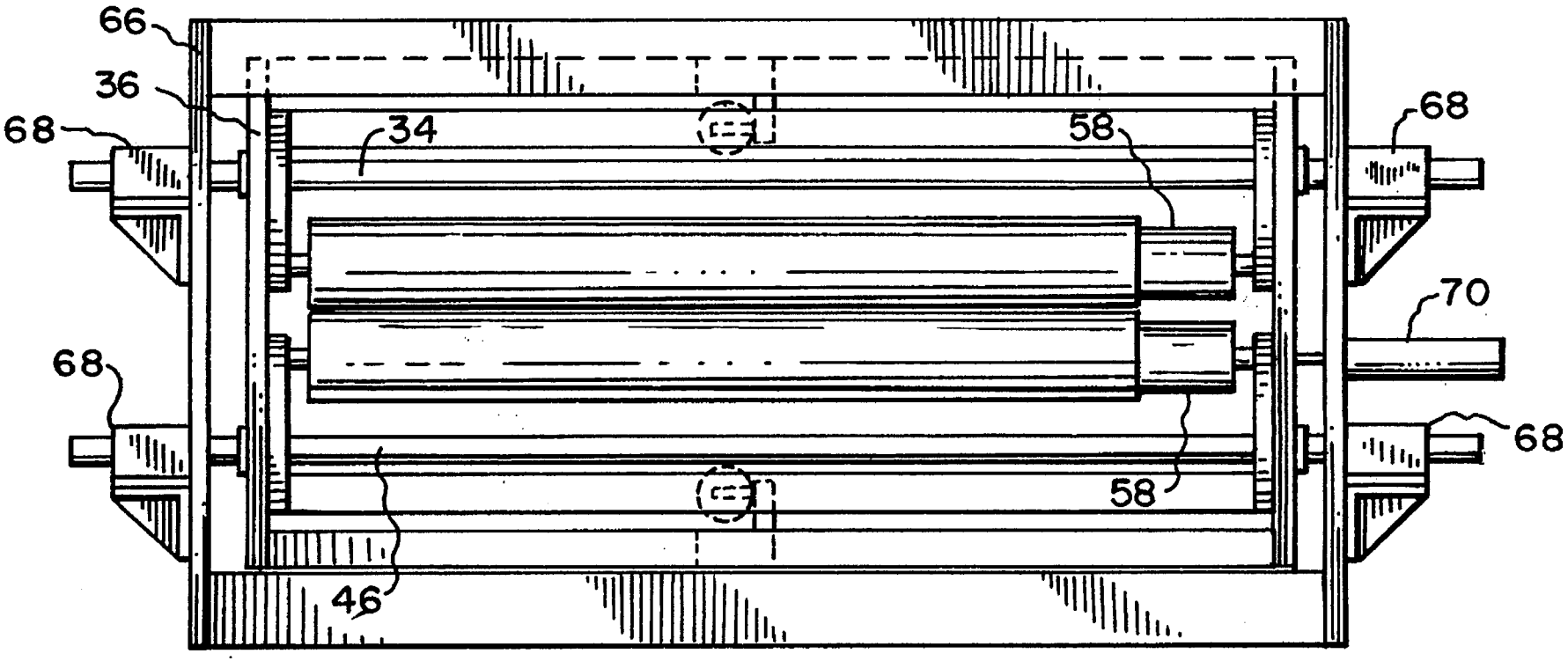
FIG. 6 is a view, like FIG. 5, also showing the assembly of two CCRs in a movable frame mounted in a fixed frame, and showing means for reciprocating the movable frame with respect to the fixed frame.

One means for axially reciprocating a contact cleaning roller while the CCR is cleaning a substrate is shown in FIGS. 3 and 6. A frame 66, fixed in space with respect to process roller 10, surrounds movable frame 36, the protruding ends of first and second shafts 34 and 46 extending through openings in fixed frame 66 and being journalled for sliding motion, for example, in linear bearings 68, on frame 66. A third actuator 70, for example, a double-acting pneumatic or hydraulic cylinder, is disposed on fixed frame 66 and extends through an opening therein to attachment on an end of movable frame 36. The motion of the actuator can be programmed by known means to drive the movable frame, and therefore the CCRs disposed therein, in a direction which is axial with respect to the CCRs, and parallel and transverse to the surface being cleaned. Other means for reciprocation can include other known apparatus, for example, cams, pulleys, and electric stepper motors.

Alternatively to the configuration described above while achieving the same effect, shafts 34 and 46 can be fixed to fixed frame 66 and can be journalled instead of fixed in movable frame 36. Frame 36 and the four pivot arms will then slide along the fixed shafts during reciprocation.

Preferably, the axial motion of frame 36 is reciprocating, or cyclical. Possible honing of the substrate surface by the particle-carrying CCR can be avoided by limiting the speed of reciprocation relative to the line speed of the substrate. At high line speeds such as 1000 fpm, the reciprocating speed is preferably less than 0.0001 times the line speed of the substrate. At lower line speeds such as 100 fpm, lower ratios such as 0.01 times the line speed are possible.

A CCR can be displaced axially over at least several inches if desired to extend the service interval between renewals or as required by the load of particles being delivered along the edges of the substrate. Substantial increases in CCR service intervals can be achieved via the apparatus and methods of the subject invention. A corresponding increase in average cleanliness of the substrate passing by the CCR is also achieved.

Figure 9:
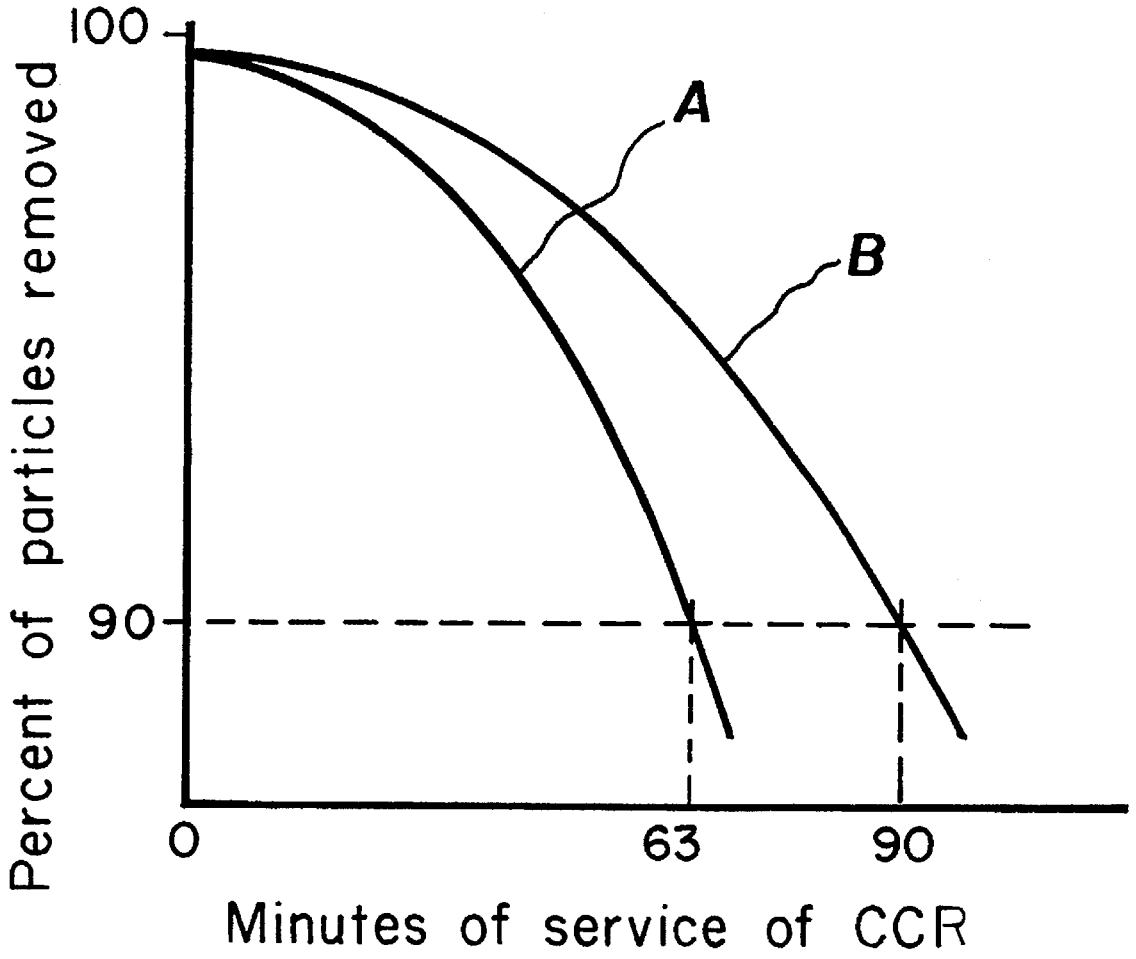
FIG. 9 is a graph showing typical enhancement of the cleaning lifetime of a CCR when used in accordance with the apparatus and methods of the subject invention.

Results of a representative test are shown in FIG. 9. A CCR is placed in contact cleaning service against a substrate moving at 500 fpm and carrying a particle load predominantly along its edges. The CCR is not reciprocated axially, and the percentage of particles removed by the CCR from along the edges of the substrate is measured over time. After 63 minutes, only 90% of the particles are being removed, as shown in Curve A. The other 10% of the particles remain on the substrate, and the CCR must be changed out for replacement and renewal. The same test is then performed with the renewed CCR, but during the entire cleaning period the CCR is axially reciprocated along the substrate surface at a rate of 0.1 feet per minute and a maximum stroke or excursion of 3 inches. As shown in Curve B, the 90% removal point is reached after 90 minutes of service, resulting in a 43% gain in inter-renewal service time and also a 43% improvement in average substrate cleanliness (ratio of areas under the curves).

Figure 7:
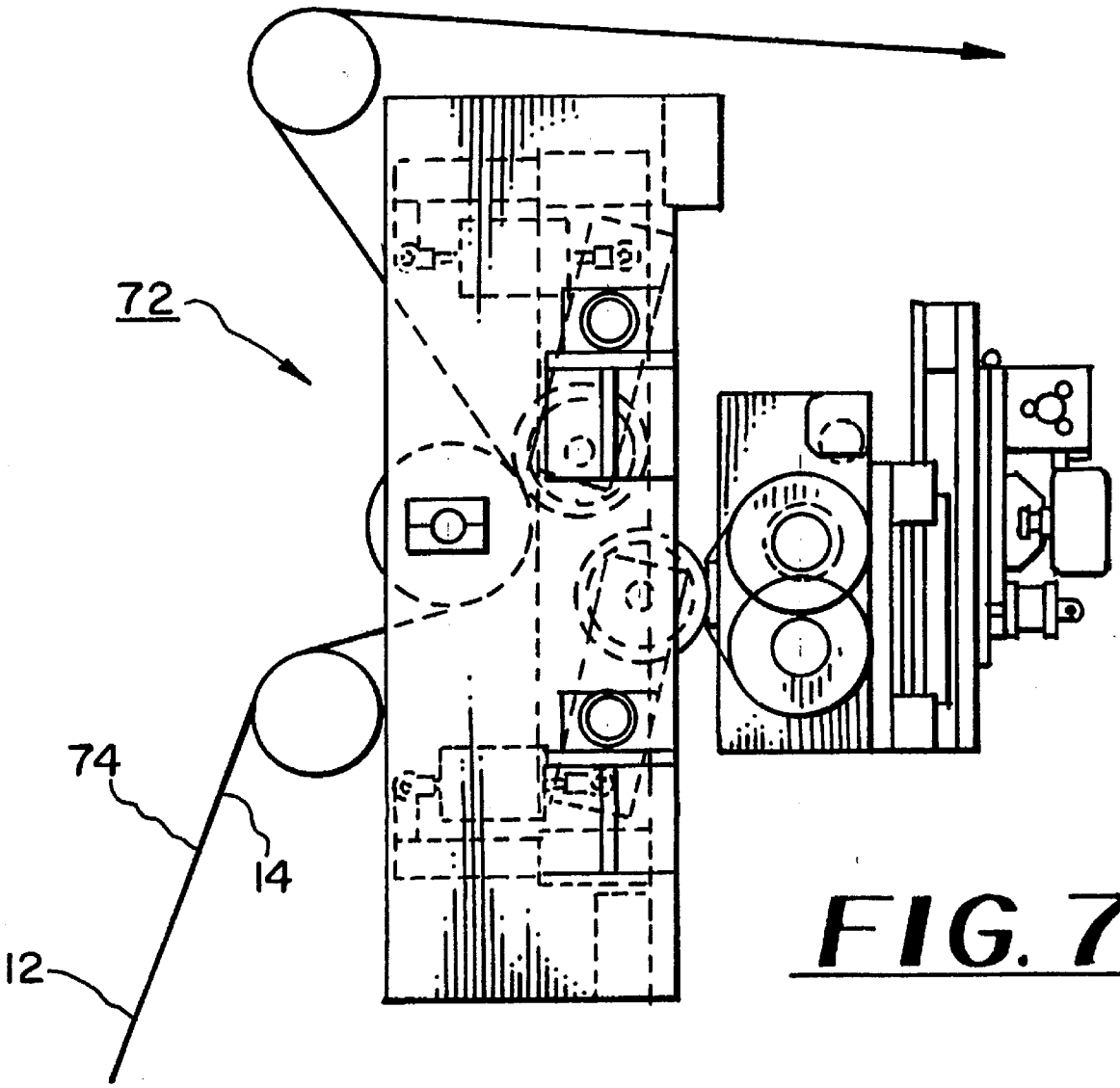
FIG. 7 is a schematic, vertical cross-sectional view of a complete installation for cleaning a web with two alternating CCRs and for renewal of either CCR.
Figure 8:
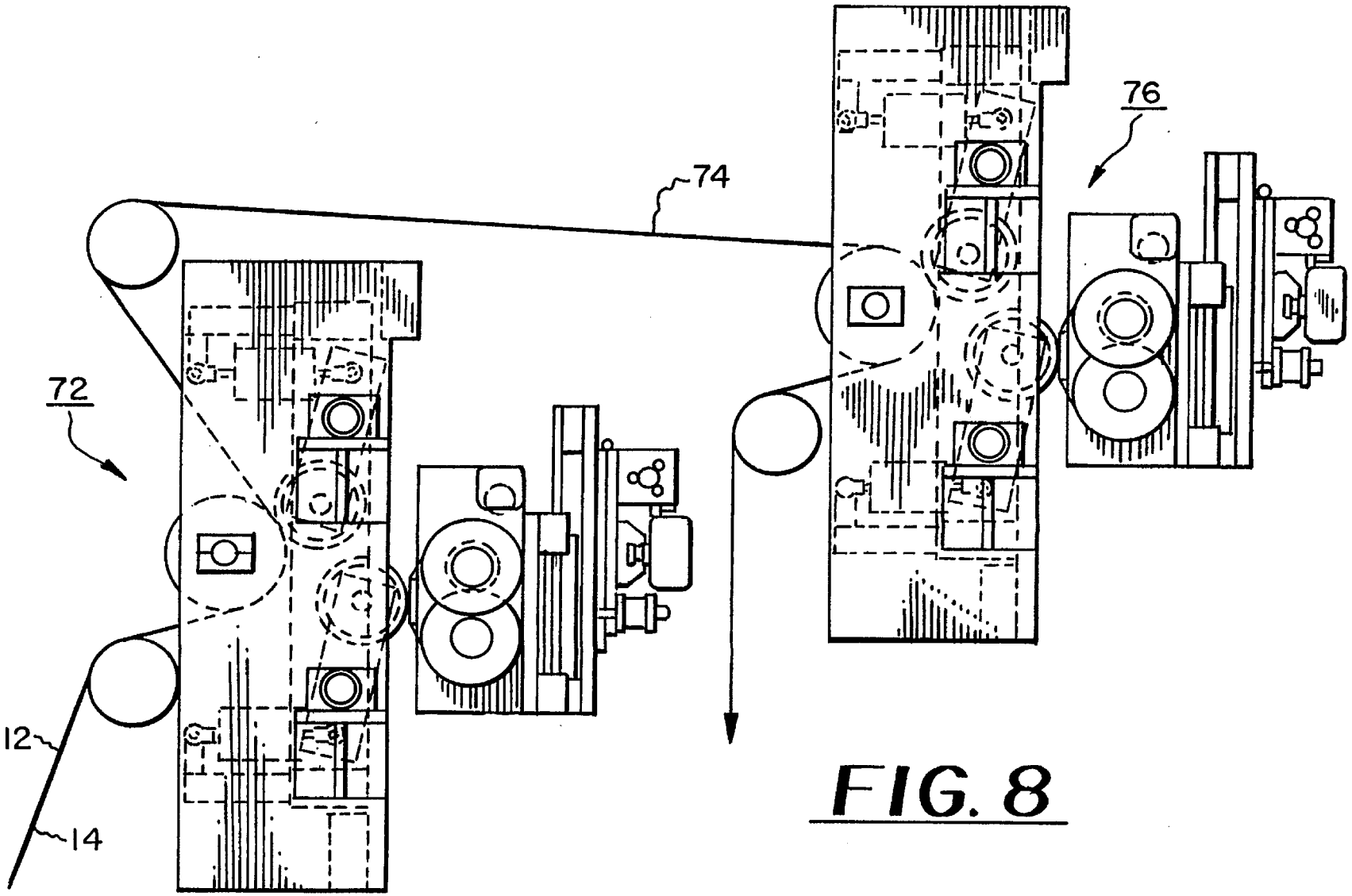
FIG. 8 is a view, like FIG. 7, also showing a second complete installation like the one in FIG. 7 disposed for cleaning the opposite surface of the web.

A complete system 72 for cleaning first surface 14 of web substrate 12 in accordance with the invention is shown in FIG. 7. If cleaning second surface 74 is also required, a second system 76, preferably substantially identical to assembly 72, can be disposed, for example, as shown in FIG. 8.

The CCR system shown in the figures and described hereinabove includes rollers which are longer than the width of the web being cleaned and which overlap both web edges at all times during reciprocation. Other embodiments (not shown) may include, for example, a CCR which is shorter than the width of the substrate and may overlap only one edge, if only one edge requires cleaning. Some substrates, for example, calender rollers, may not require continuous cleaning of all areas of the surface but instead may need scavenging of particles at short intervals. A CCR system having CCRs much narrower than a process roller (not shown) can be configured and programmed to reciprocate continuously across the entire width of a process roller, thereby keeping the surface of the process roller acceptably clean.

A CCR system in accordance with the invention does not necessarily have to be capable of reciprocating motion of a CCR only with the CCR in contact with the substrate surface being cleaned. In some applications, it may be desirable to retract the CCR from contact with the surface, index the CCR axially to a new position, and then re-establish contact with the substrate surface. This action has the inventive effect of distributing the particles collected by the roller over a broader area of the roller surface and thus extending the operating lifetime of the roller between renewals in accordance with the invention.

From the foregoing description it will be apparent that there has been provided improved apparatus and method for cleaning a substrate surface, wherein a contact cleaning roller is caused to reciprocate in its axial direction while rolling along the substrate surface, thereby distributing particles from the substrate surface over an axially broad area of the roller surface, thus extending the cycle lifetime of the cleaning roller, decreasing the slope of its effective contamination curve, and increasing the average cleanliness of surface cleaned between roller renewals. Variations and modifications of the herein described system, within the scope of the invention, will undoubtedly suggest themselves to those skilled in this art. Accordingly, the foregoing description should be taken as illustrative and not in a limiting sense.

What is claimed is:

1. A system for cleaning particles from a substrate having a first surface, comprising a contact cleaning roller rotatably mounted on a first frame, said roller having an axis of rotation and a cylindrical outer surface defining a cleaning surface contactable with said first substrate surface, said first frame being pivotable to place said roller into contacting relationship with said substrate surface to enable said roller to roll along said first substrate surface at a first velocity with a force between said respective surfaces to transfer said particles from said first substrate surface to said cleaning surface, said first frame also being translatable at a second velocity to displace said contact cleaning roller along said axis of rotation while rolling along said first substrate surface, the ratio of said second velocity to said first velocity being less than about 0.01.

2. The system in accordance with claim 1 wherein said axial displacement of said roller is reciprocating.

3. The system in accordance with claim 1 wherein said first substrate surface has edges defining a finite width of said first substrate surface in the axial direction of said cleaning roller, and said cleaning surface is wider than said first substrate surface and extends beyond both edges of said first substrate surface during said axial displacement.

4. The system in accordance with claim 1 wherein said first substrate surface has edges defining a finite width of said first substrate surface in the axial direction of said cleaning roller, and said cleaning surface is narrower than said first substrate surface.

5. The system in accordance with claim 4 wherein said cleaning surface extends beyond one of the edges of said first substrate surface during said axial displacement.

6. The system in accordance with claim 1 wherein said substrate is selected from the group consisting of a process roller, a continuous web, and a sheet, and wherein said cleaning roller is mounted in non-interfering relationship with said substrate.

7. The system in accordance with claim 1 wherein said contact cleaning roller is a first contact cleaning roller and said system further comprises a second contact cleaning roller mounted in a second pivotable frame and disposable into contacting relationship with said first contact cleaning roller to transfer particles from said second contact cleaning roller to said first contact cleaning roller, the cleaning surface of said second contact cleaning roller being less tacky than said cleaning surface of said first contact cleaning roller.

8. The system in accordance with claim 7 wherein said second contact cleaning roller is disposable to clean a surface of a substrate selected from the group consisting of a process roller, a continuous web, and a sheet.

9. The system in accordance with claim 1 wherein said first substrate surface is stationary and said first frame is translatable in a direction normal to said axial direction to roll said cleaning roller along said first substrate surface.

10. The system in accordance with claim 1 wherein said first frame is stationary in a direction normal to said axial direction and said substrate is movable past said roller with said roller cleaning surface rolling along said first substrate surface.

11. The system in accordance with claim 1 wherein said cleaning surface comprises a polymeric material.

12. The system in accordance with claim 11 wherein said polymeric material is selected from the group consisting of polyurethane, silicone rubber, neoprene rubber, and butyl rubber.

13. The system in accordance with claim 1 wherein said substrate further has a second substrate surface opposite said first substrate surface, said system further comprising a second contact cleaning roller rotatably mounted on a second frame, said second roller having a second axis of rotation and a cylindrical outer surface defining a second cleaning surface contactable with said second substrate surface, said second frame being pivotable to place said second roller into contacting relationship with said second substrate surface to enable said second roller to roll along said second substrate surface with sufficient force between said respective surfaces to transfer particles from said second substrate surface to said second cleaning surface, said second frame also being translatable to displace said second roller along said second axis of rotation while rolling along said second substrate surface.

14. A system for cleaning particles from a substrate having a first surface, comprising:

a) a first contact cleaning roller rotatably mounted on a movable frame, said roller having an axis of rotation and a cylindrical outer surface defining a cleaning surface contactable with said first substrate surface, said movable frame being pivotable to place said first roller into contacting relationship with said substrate surface to enable said roller to roll along said first substrate surface with a force between said respective surfaces to transfer said particles from said first substrate surface to said cleaning surface, said movable frame also being translatable to displace said first contact cleaning roller along said axis of rotation while rolling along said first substrate surface;

b) a fixed frame to support said system;

c) first and second shafts within said fixed frame and supporting said movable frame for reciprocal movement of said movable frame in a direction parallel to said axis of said first contact cleaning roller;

d) first and second pivot arms disposed on said first shaft within said movable frame and connected for parallel movement by a first crossmember, said first and second pivot arms rotatably supporting said first contact cleaning roller within said movable frame, and said first crossmember being disposed to pivot said first contact cleaning roller into and out of cleaning relationship with said substrate surface;

e) a first actuating cylinder operable between said movable frame and said first crossmember to change the location of said first contact cleaning roller with respect to said substrate surface;

f) a second contact cleaning roller having an axis substantially parallel to said axis of said first contact cleaning roller;

g) third and fourth pivot arms disposed on said second shaft within said movable frame and connected for parallel movement by a second crossmember, said third and fourth pivot arms rotatably supporting said second contact cleaning roller within said movable frame, and said second crossmember being disposed to pivot said second contact cleaning roller into and out of cleaning relationship with said substrate surface;

h) a second actuating cylinder operable between said movable frame and said second crossmember to change the location of said second contact cleaning roller with respect to said substrate surface; and i) means attached to said fixed frame and said movable frame for moving said movable frame with respect to said fixed frame.

15. A system in accordance with claim 14 further comprising a roller cleaner mounted on said movable frame, disposed to be in position to clean either of said first and second contact cleaning rollers when either of said rollers is out of substrate cleaning position, said roller cleaner being mounted to be reciprocable along the surface of either of said rollers in a direction parallel to said axis of said rollers.

16. A system in accordance with claim 14 further comprising means for matching the linear velocity of the surface of either of said first and second contact cleaning rollers with the linear velocity of said substrate surface before said contact cleaning roller is brought into contact with said substrate surface.

17. A system in accordance with claim 14 wherein said means for moving said movable frame is selected from the group consisting of pneumatic cylinder, hydraulic cylinder, electric motor, and mechanical eccentric.

18. A system in accordance with claim 14 wherein said shafts are fixedly attached to said movable frame and are journalled on said fixed frame.

19. A system in accordance with claim 14 wherein said shafts are fixedly attached to said fixed frame and are journalled on said movable frame.

20. A method for cleaning particles from a substrate having a surface, comprising the steps of:

a) providing a contact cleaning roller having a cleaning surface;

b) rolling said cleaning surface of said contact cleaning roller along said substrate surface at a first velocity with a force therebetween to cause particles to be transferred from said substrate surface to said cleaning surface; and c) displacing said contact cleaning roller at a second velocity in a direction along its axis during said rolling step, the ratio of said second velocity to said first velocity being less than about 0.01.

21. A method in accordance with claim 20, further comprising the steps of:

a) moving said contact cleaning roller out of contact with said substrate surface;

b) displacing said contact cleaning roller in a direction along its axis while out of contact with said substrate surface; and c) moving said contact cleaning roller into contact with said substrate surface.

22. A method in accordance with claim 20 wherein said ratio is between about 0.01 and about 0.0001.

23. A method in accordance with claim 20 wherein said displacing movement is reciprocal motion.

24. A method in accordance with claim 23 wherein the length of excursion of said reciprocation is between about 0 and about 5 inches.

* * * * *

UNITED STATES PATENT AND TRADEMARK OFFICE

CERTIFICATE OF CORRECTION

PATENT NO. : 5,611,281

DATED : March 18, 1997

INVENTOR(S) : Corrado et al.

It is certified that error appears in the above-indentified patent and that said Letters Patent is hereby corrected as shown below:

On the title page item [73], Assignee: SeraTek LLC, Livonia N.Y.

Signed and Sealed this

Nineteenth Day of August, 1997

*Attest:*

*Attesting Officer*

BRUCE LEHMAN

*Commissioner of Patents and Trademarks*